United States Patent [19]

Dallman

[11] 4,404,950

[45] Sep. 20, 1983

[54] AUTOMOTIVE FUEL SAVING SYSTEM

[76] Inventor: Alfred C. Dallman, 2437 Bending Willow Dr., Kettering, Ohio 45440

[21] Appl. No.: 347,382

[22] Filed: Feb. 9, 1982

[51] Int. Cl.[3] ..... F02M 25/06

[52] U.S. Cl. ..... 123/572; 123/573

[58] Field of Search ..... 123/572, 573, 574, 41.86

[56] References Cited

U.S. PATENT DOCUMENTS

| | | | |
|---|---|---|---|
| 1,286,930 | 12/1918 | Buckner . | |
| 1,299,790 | 4/1919 | Scott . | |
| 1,950,586 | 3/1934 | Zubaty | 123/572 |
| 1,981,290 | 11/1934 | Spiegel et al. | 123/572 |
| 2,271,150 | 1/1942 | Dressler | 123/119 |
| 3,246,639 | 4/1966 | Oliver | 123/572 |
| 3,473,299 | 10/1969 | Powers | 123/572 |
| 3,545,416 | 12/1970 | Brimer | 123/572 |
| 3,630,182 | 12/1971 | Grainger | 123/119 |
| 3,990,421 | 11/1976 | Grainger | 123/122 |
| 4,279,236 | 7/1981 | Dallman | 123/572 |

OTHER PUBLICATIONS

Chilton's Manual, (1972), pp. 1382–1385.

*Primary Examiner*—Ronald H. Lazarus

*Attorney, Agent, or Firm*—Donald J. Singer; John R. Flanagan

[57] ABSTRACT

An improved system for ventilating and utilizing crankcase vapors in an internal combustion engine uses an air pump for feeding air to both the first and second air flow circuits of the system such that air and crankcase vapors will be withdrawn from the engine crankcase to the first circuit and directed to the engine intake system, while air will be added to the crankcase from the second circuit. The air pump is connected to and driven by the engine such that feeding of air to the first and second circuits is regulated in direct proportion to the rpm of the engine.

3 Claims, 7 Drawing Figures

AUTOMOTIVE FUEL SAVING SYSTEM

RIGHTS OF THE GOVERNMENT

The invention described herein may be manufactured and used by or for the Government of the United States for all governmental purposes without the payment of any royalty.

BACKGROUND OF THE INVENTION

1. Field of the Invention

The present invention relates broadly to the utilization of the crankcase vapors in gasoline powered internal combustion engines and, more particularly, is concerned with the improvement of an automotive fuel saving system which utilizes such vapors.

2. Description of the Prior Art

The directing of crankcase vapors into the air intake system of an internal combustion engine is an old, well known art. U.S. Pat. Nos. 1,286,930 issued in 1918 to Buckner and 1,299,790 issued in 1919 to Scott, disclose early systems for utilizing crankcase vapors.

Basically, the crankcase vapors of internal combustion engines consist of two major components, the blowby gases, i.e., the carbureted mixture plus exhaust gases passing by the rings of the piston, and vaporized and entrained particles of the lubricating oils in the crankcase that have been aerified or vaporized due primarily to agitation. The blowby gases contain large amounts of hydrocarbon gases that have a relatively high fuel energy content and can be burned in the engine to provide power that might otherwise be wasted. The aeriated lubricating oil in the crankcase vapor frequently contains relatively large and heavy particulate matter. Generally, without further breaking down of these particles, they are detrimental to passages in the carburetor, and in modern systems they build up and eventually clog the conventional PCV (positive crankcase ventilation) valve.

While many systems for utilizing crankcase vapors have been proposed in the past, none have proven to be as satisfactory as the system disclosed in U.S. Pat. No. 4,279,236 which issued July 21, 1981 to the inventor of the present invention. The system of the aforesaid patent primarily includes three air flow circuits for efficiently handling crankcase vapors in a substantially maintenance free manner. In a first air flow circuit, ram air captured by an air scoop and cooperating with an aspirator draws crankcase vapors from the crankcase of the internal combustion engine. Heavy particulate matter in the crankcase vapor is separated, heated and further vaporized by a heat exchanger cooperating with an exhaust manifold of the engine. A second aspirator in the first circuit draws the vaporized particulate matter back into the original vapor stream of the first air flow circuit. The crankcase vapors mixed with the incoming ram air are then directed into the interior cavity of the carburetor air filter. In a second air flow circuit, ram air captured by another air scoop and filtered in the circuit is directed into the crankcase and carburetor air filter cavity, while in a third air flow circuit, filtered air is drawn through a variable annular orifice and metered in accordance with intake manifold pressure into the engine air intake system below the carburetor throttle plate.

While this system of the aforesaid patent accomplishes its intended purpose in an uncomplicated and efficient manner, there is need for improvement in its operating efficiency. The system relies on the automobile fan to boost the ram air flow, so that air flow will be present even though the car with the engine running is not in motion. Predominately, however, the quantity of air entering the air scoops is a function of the speed of the vehicle. Under some operating conditions, reliance upon fan and car motion for creation of ram air flow is less desirable than more direct reliance, for example, upon the revolution per minute (rpm) level of the car engine. Therefore, a need exists for improving the design and efficiency of the system without eliminating any of the advantages fostered by the system in utilizing the crankcase vapors as supplemental fuel.

SUMMARY OF THE INVENTION

The present invention provides an improvement of the automotive fuel saving and crankcase ventilating system of the above-cited patent, which is designed so as to substantially satisfy the aforementioned need. The improved system employs an air pump in lieu of the two air scoops of the earlier design to collect ram air for feeding the fuel saving system. Furthermore, the improved system incorporates modifications in the first and second air flow circuits of the earlier fuel saving system to accommodate the use of the air pump. Now, the air flow output from the air pump, which is belt driven off the engine shaft, increases (or decreases) in direct proportion to an increase (or decrease) in engine rmp. As a result, better control is gained and maintained over the air flow for improved efficiency in automotive crankcase ventilation and waste fuel vapor recirculation.

Accordingly, the present invention provides an improved system for ventilating and utilizing crankcase vapors in an internal combustion engine. The engine has a sealed crankcase and an air-fuel intake system. The system has a first air flow circuit for withdrawing crankcase vapors from the engine crankcase and directing the same into the engine intake system, a second air flow circuit for providing a flow of air into the engine crankcase, and a third air flow circuit for metering air into the engine intake system to provide compensation for the addition of crankcase vapors into the intake system.

The improvement of the present invention to the crankcase ventilating and vapor utilizing (fuel saving) system is the provision of an air pumping means for feeding air to both the first and second air flow circuits such that air and crankcase vapors will be withdrawn from the crankcase to the first circuit, while air will be added to the crankcase from the second circuit. In such manner, a continuous circulation of air through the crankcase and ventilation of the fuel vapors therefrom is achieved, accompanied by combustion of the vapors in the engine through its intake system. Preferably, the air pumping means is driven by the engine so that the flow of air to the first and second circuits is regulated in direct proportion to the rpm of the engine.

DETAILED DESCRIPTION OF THE INVENTION

Figure 1:
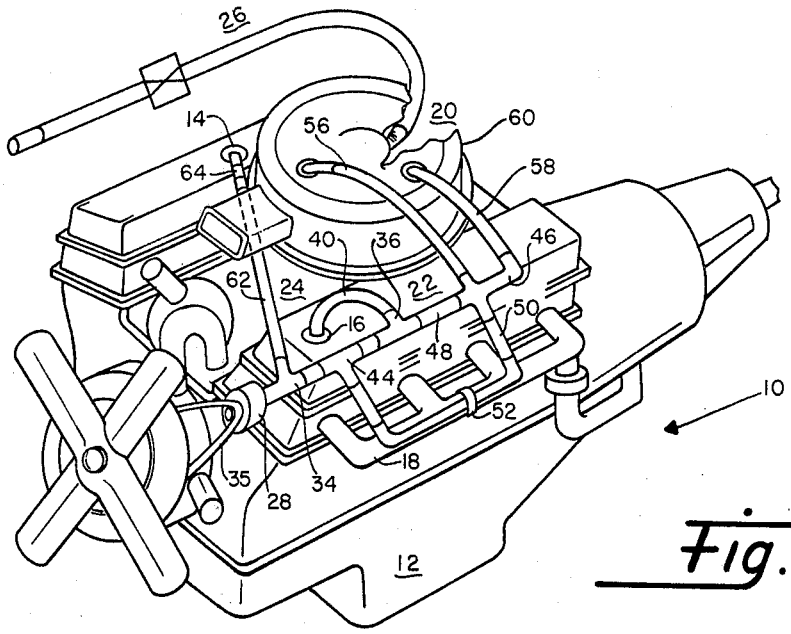
FIG. 1 is a schematic perspective view of an internal combustion engine fitted with an embodiment of the improved automotive fuel saving and crankcase ventilating system of the present invention.
Figure 2:
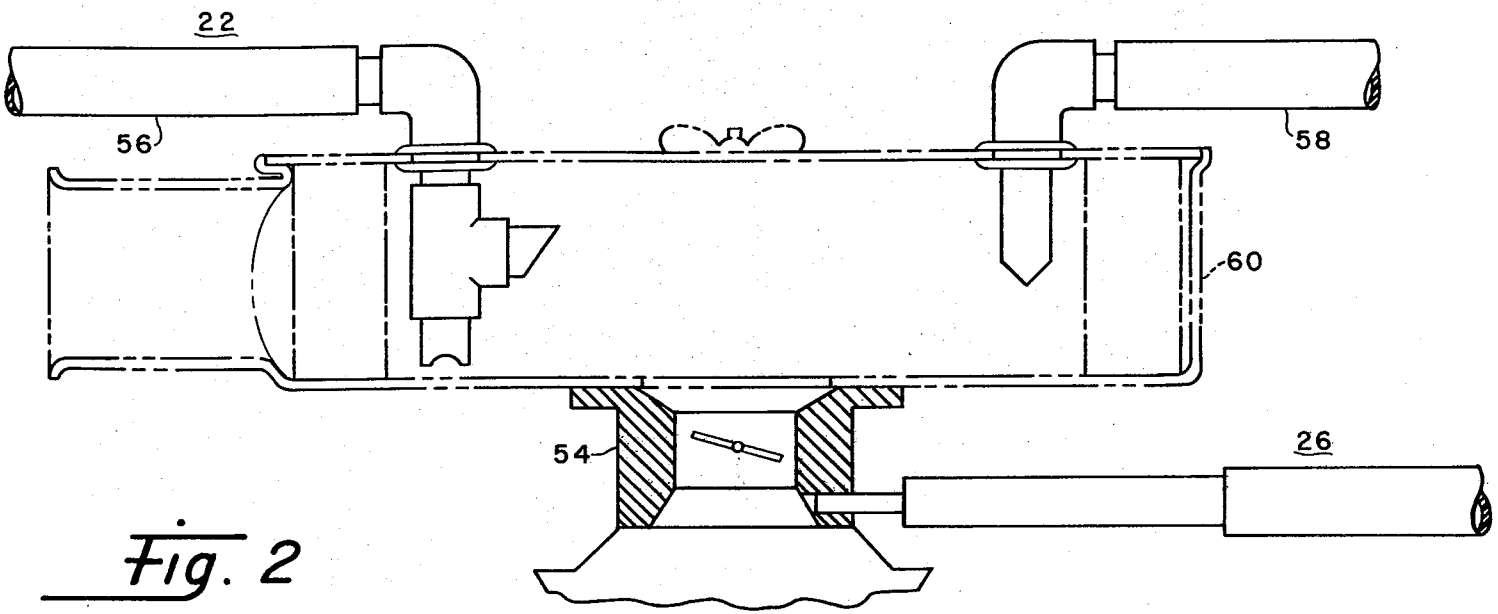
FIG. 2 schematically illustrates the modifications made to the air-fuel inlet system of an internal combustion engine to use the fuel saving and crankcase ventilating system.

Referring now to the drawings, and more particular to FIG. 1, there is illustrated a typical embodiment of the present invention attached to a conventional V-8 type automobile internal combustion engine, generally designated 10. It is to be understood that the present invention is applicable to all internal combustion engines having a sealed crankcase 12 containing a lubricating fluid with a crankcase ventilation input orifice 14 and a crankcase ventilation output orifice 16, an exhaust manifold 18, and an air and fuel intake system 20. The air and fuel intake system 20 of FIG. 1 is further detailed, schematically in FIG. 2. FIGS. 1 and 2 should be considered together in the following description of a typical embodiment of the present invention.

As in the earlier system of the aforesaid U.S. Pat. No. 4,279,236, the improved system primarily includes three air flow circuits: a first curcuit 22, a second circuit 24, and a third circuit 26. The third air flow circuit 26 of the present invention is substantially identical to the corresponding circuit of the aforesaid patent, and therefore will not be further described herein. The first and second air flow circuits 22 and 24 have been modified in the present invention from their corresponding arrangements in the earlier system to accommodate the improvements covered herein.

Figure 3:
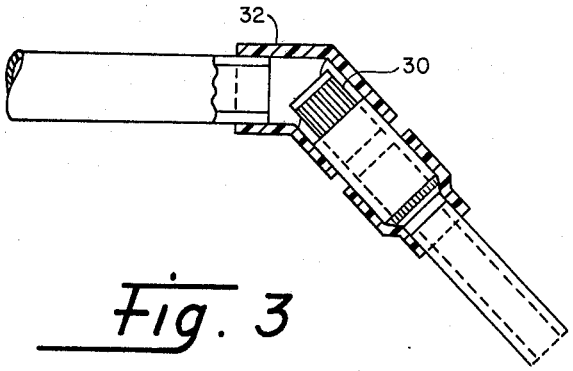
FIG. 3 schematically illustrates an in-line air filter.

The improvement of the present invention relates primarily to the provision of an air pump 28, replacing the pair of air scoops used in the earlier system, for feeding air to both the first and second air flow circuits 22, 24. The air flow from the pump 28 must be passed through an air filter, as was the case in the earlier system, to restrain the entry of dust and other particles into the system. FIG. 3 illustrates a suitable conventional pleated paper filter 30, such as a Fram type CG12, positioned in a 45° elbow fitting 32. In some applications, it is desirable to provide an angle fitting; however, obviously, the filter will function just as satisfactorily in a straight fitting. Alternatively, the air filter may be incorporated into the air pump as is the case with the pump used herein. The air pump used may be part number 7832804 manufactured by General Motors. Preferably, the air pump is driven by the engine via a belt 35 so that the flow of air to the first and second circuits is regulated in direct proportion to the rpm of the engine.

Figure 4:
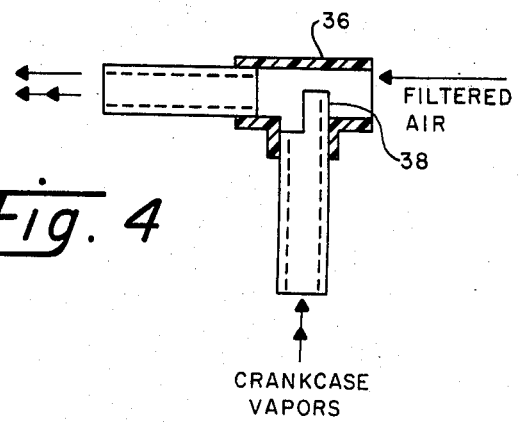
FIG. 4 schematically illustrates an aspirator tee.
Figure 7:
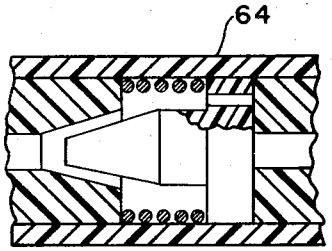
FIG. 7 is a schematic sectional view of a typical variable annular orifice valve used in the air dilution circuit of the system.
Figure 6:
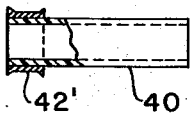
FIG. 6 schematically illustrates a typical crankcase outlet for Ford and General Motors type cars.
Figure 5:
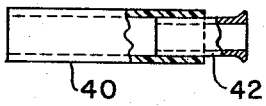
FIG. 5 schematically illustrates a typical crankcase outlet fitting for Chrysler automotive cars.

By providing a dual output from the air pump 28 to the first and second circuits via a reducing tee 34, a positive forced air circulation system is created for effectively ventilating gases or vapors from the crankcase 12. The presence of a first aspirator tee 36 in the first circuit 22 creates a negative pressure at the output orifice 16 of the crankcase. This condition ensures that the flow path of air circulation is, as desired, into the inlet orifice 14 through the interior of the crankcase 22 and out its output orifice 16. A suitable construction for the aspirator tee 36 is shown in detail in FIG. 4. The flow of air over and around the cut-away end of the stem 38 of the tee provides a reduced pressure in the draw tube 40 connected to the stem of the tee which assists in withdrawal of gases from the crankcase 12. The tube 40 is coupled to a fitting, either 42 or 42' as illustrated respectively in FIGS. 6 or 7, which is inserted into the crankcase ventilation outlet orifice 16.

Thus, one modification to the first and second air flow circuits 22, 24 of the improved system is their connection together at their inlet ends near to where they are coupled to the air pump 28 so that they can employ the pump as a common source of air flow. Another modification in the first circuit 22 relates to the position of a second aspirator tee 44 (identical in construction to tee 36) upstream from the first aspirator tee 36. In the earlier system, the positions of the tees are reversed, that is, the first tee is upstream of the second tee. Also, a third plenum tee 46 is located downstream both of the first and second tees 36, 44, as in the earlier system, but now closer to the first tee 36 than the second tee 44.

As in the earlier system, the first air flow circuit 22 includes a first pipe 48 and a second, U-shaped pipe 50. However, in the improvement of the present invention, the pipes 48, 50 are arranged somewhat differently. Now, the first pipe 48 is coupled at its opposite ends to the air/fuel intake system 20 and the air pump 28, and intermediate its opposite ends to the crankcase 12 via the first aspirator tee 36. The first pipe 48 extends approximately horizontally and provides the main air flow stream from the air pump 28 to the intake system 20 for withdrawing vapors from the crankcase.

Also, now, the second U-shaped pipe 50 is connected at its opposite ends to the first pipe 48 via the second aspirator and third plenum tees 44, 46 both upstream and downstream of the connection of the first pipe 48 to the crankcase 12 via the first tee 36. The second pipe 50 provides an auxiliary air flow stream from the plenum tee 46 and back to the main air flow stream in the first pipe 48 through the aspirator tee 44. The lower horizontally-extending metallic portion of the second pipe 50 is connected by a clamp 52 to, and disposed in heat exchange relationship with, the exhaust manifold 18 for heating air in the auxiliary flow stream through the second pipe 50.

As mentioned in the aforesaid patent, part of the crankcase vapors consist of relatively large heavy particulate matter that would be detrimental to the passages in the carburetor 54 of the air/fuel intake system 20. Consequently, the heavy particulate matter moves by gravity with air through the third plenum tee 46 into the auxiliary flow stream where it is heated and further vaporized prior to introduction back into the main air flow stream in the first pipe at the second aspirator tee 44 and therefrom into the engine intake system 20.

From the plenum tee 46, two tubes 56, 58 lead to different areas of an intake air filter 60 of the intake system 20. Alternatively, one tube of larger cross-section may be used. The now fully vaporized crankcase emissions are fed into the air filter 60, preferably at central areas thereof as seen in FIG. 2. The arrangement of the intake system 20, as seen in FIG. 2, is essentially the same as that in the earlier system described in the aforesaid U.S. Pat. No. 4,279,236. Therefore, it need not be described further herein.

Still another modification embodied in the improvement provided by the present invention is the elimination of the connection between a main pipe 62 of the second circuit 24 and the intake air filter 60. Now the first and second circuits 22, 24 provide a relatively closed circuit, with the crankcase 12 and the intake system 20 for providing continuous circulation of air from the air pump 28 through the crankcase 12 and ventilation of fuel vapors therefrom to the engine intake system 20, accompanied by combustion of the vapors in the engine. Also, a variable annular orifice 64 is incorporated into the pipe 62 to selectively control air flow into the crankcase 12.

It is to be noted that the present invention does not in any way alter or modify the tuning of the engine for minimum air pollution. The same procedures and adjustments to produce a leanburn engine may be used with the invention as with conventional crankcase ventilation systems. The release of harmful emissions from the engine are only altered to the extent that since the efficiency of the engine is improved due to better utilization of the crankcase characteristics less fuel is consumed and total emissions per mile are lower.

It is thought that the improvement of the present invention and many of its attendant advantages will be understood from the foregoing description and it will be apparent that various changes may be made in the form, construction and arrangement of the parts described without departing from the spirit and scope of the invention or sacrificing all of its material advantages, the form hereinbefore described being merely an exemplary embodiment thereof.

Having thus described the invention, what is claimed is:

1. In a crankcase ventilating and vapor utilizing sytem for an internal combustion engine having a sealed crankcase and an air-fuel intake system, said system having a first air flow circuit for withdrawing crankcase vapors from said engine crankcase and directing the same into said engine intake system, a second air flow circuit for providing a flow of air into said engine crankcase, and a third air flow circuit for metering air into said engine intake system to provide compensation for the addition of said crankcase vapors into said intake system, the improvement in said crankcase ventilating and vapor utilizing system comprising:

air pumping means connected to both said first and second circuits for feeding air to said first and second circuits such that air and crankcase vapors will be withdrawn from said crankcase to said first circuit and directed to said engine intake system, as air is added to said crankcase from said second circuit, whereby a continuous circulation of air through said crankcase and ventilation of vapors therefrom is achieved, accompanied by combustion of said vapors in said engine after introduction through its intake system.

2. The crankcase ventilating and vapor utilizing system as recited in claim 1, wherein:

said first circuit includes a first pipe being coupled at its opposite ends to said air pumping means and said intake system and intermediate its opposite ends to said crankcase, said first pipe providing a main air flow stream for withdrawing said crankcase vapors, said first circuit further including a second pipe being connected to said first pipe both upstream and downstream of said connection of said first pipe to said crankcase so as to provide an auxiliary air flow stream from and back to said main air flow stream; and said engine has an exhaust manifold with said second pipe being disposed in heat exchange relationship therewith for heating air and large heavy particulate matter in said auxiliary flow stream which further vaporizes said heavy particulate matter prior to introduction of said vapor into said engine intake system.

3. The crankcase ventilating and vapor utilizing system as recited in claims 1 or 2, wherein said air pumping means is connected to and driven by said engine such that the feeding of air to said first and second circuits is regulated in direct proportion to the rpm of said engine.

* * * * *